US006032295A

United States Patent [19]

Marshall

[11] Patent Number: 6,032,295

[45] Date of Patent: Mar. 7, 2000

[54] MOISTURE-ABSORBENT SOCK

[76] Inventor: James B. Marshall, 137 Victoria Avenue, Remuera, Auckland, New Zealand

[21] Appl. No.: 09/310,501

[22] Filed: May 12, 1999

[51] Int. Cl.[7] ..... F01L 15/00; A41B 9/02; A41B 11/02; D04B 11/00

[52] U.S. Cl. ..... 2/239; 66/178 R; 66/178 A; 66/183

[58] Field of Search ..... 2/239; 66/202, 66/178 R, 183, 184, 178, 188, 194, 195, 196, 200

[56] References Cited

U.S. PATENT DOCUMENTS

| | | | |
|---|---|---|---|
| 3,793,851 | 2/1974 | Thorneburg | 66/185 |
| 4,195,497 | 4/1980 | Goldstein et al. | 66/185 |
| 4,422,307 | 12/1983 | Thorneburg | 66/172 E |
| 4,702,091 | 10/1987 | Good et al. | 66/171 |
| 4,898,007 | 2/1990 | Dahlgren | 66/185 |
| 5,035,008 | 7/1991 | Schneider | 2/239 |
| 5,095,548 | 3/1992 | Chesebro, Jr. | 2/239 |
| 5,226,194 | 7/1993 | Staley | 2/239 |
| 5,353,524 | 10/1994 | Brier | 26/55 |
| 5,509,282 | 4/1996 | Ferrell, Jr. | 66/188 |
| 5,511,323 | 4/1996 | Dahlgren | 36/3 |
| 5,617,745 | 4/1997 | Corte et al. | 66/178 A |

*Primary Examiner*—John J. Calvert
*Assistant Examiner*—Robert H. Muromoto, Jr.
*Attorney, Agent, or Firm*—Jack V. Musgrove

[57] ABSTRACT

A sock whose leg portion has wicking regions interspersed among fabric folds which are adapted to increase the effective surface area of the leg portion. The foot and leg portions of the sock may be constructed of the same material, such as synthetic, hydrophobic yarns, and formed in a unitary manner, either by weaving or knitting. The wicking regions may be formed using stitching along outer edges of a plurality of diamond shapes. Alternatively, the wicking regions may be formed by a set of first fabric bands, wherein the fabric folds comprise a set of second fabric bands, and the first and second bands alternate horizontally along a length of the tubular leg portion. The first fabric bands are preferably elastic or stretchable to maintain the first fabric bands in intimate contact with a wearer's skin.

20 Claims, 3 Drawing Sheets

MOISTURE-ABSORBENT SOCK

BACKGROUND OF THE INVENTION

1. Field of the Invention

The present invention generally relates to clothing and apparel, specifically to stockings and hosiery, and more particularly to a sock having improved moisture absorption and dissipation characteristics imparted by the selective arrangement of folds or pleats formed using different types of cloth or stitching.

2. Description of Related Art

Many articles of modern apparel are designed with moisture control in mind. While moisture can be introduced by external means, such as a rain shower, the problem that often arises relates to moisture resulting from excessive sweating, such as during exercising or running. Loose clothing, for example, is generally preferred over tight clothing for these activities, if increased moisture evaporation and dissipation is desired. Certain fabrics (e.g., cotton) are also known to have superior wicking or cooling characteristics.

One area wherein moisture control can be particularly problematic is that surrounding the feet. Since air flow about the feet is drastically reduced when wearing shoes, excess moisture can easily build up. This excess moisture can be particularly uncomfortable under different conditions. A jogger in warm weather may feel oppressively hot and humid, or a snowskier in very cold weather may find that initial foot moisture is now contributing to colder feet. Socks provide some inherent wicking, and many different sock designs have been devised with moisture in mind.

Early moisture control socks just used hydrophobic (i.e., non-absorbent) yarns to prevent moisture buildup. These yarns were typically synthetic, e.g., nylon, acrylic, polypropylene, or polyester. More advanced moisture-wicking materials use two fabrics, one (hydrophobic) that draws moisture away from the skin, and another that conducts it to the surface for evaporation. The latter fabric is hydrophilic (i.e., moisture absorbent), such as cotton or wool. Sock liners can be used which are made of a wicking fabric only, leaving the moisture absorption to the outer sock.

It is also known to provide terry loops on the inner surface of various types of socks, particularly those referred to as sweatsocks. The terry loops not only provide a cushion for active sport participants, and thermal insulation properties, but further provide for some wicking away of perspiration from the foot of the wearer. In U.S. Pat. No. 3,793,851, a boot sock is disclosed having such terry loops, with additional fabric thickness in the heel portion to provide a more comfortable fit. An auxiliary terry yarn is knit in plated relationship with the main terry yarn, wherein the main and auxiliary terry yarns both wick moisture from the foot to an outer layer of the sock. The leg portion of the sock includes elastic yarns which help maintain the leg portion in intimate contact with the skin. A similar design in shown in U.S. Pat. No. 4,422,307.

Socks have been designed to conduct moisture from certain areas of the sock to other areas. As taught by U.S. Pat. No. 4,898,007, a sock may be constructed of a first zone at the toe wherein the yarn is predominantly hydrophilic, a second zone at the heel wherein the yarn is also predominantly hydrophilic, and a third zone at the instep wherein the yarn is predominantly hydrophobic. As a result of the wicking action, moisture is transferred from the heel and toe to the instep of the sock. The upper leg portion may also be hydrophobic.

In the moisture control sock described in U.S. Pat. No. 5,095,548, a body yarn is knit in successive courses throughout the leg and foot portions. Other yarns (hydrophobic and hydrophilic) are knitted in partial courses and in plated relationship, whereby moisture generated at the sole of the sock is similarly wicked to the instep for evaporation. The cuff and upper leg portions again have elastic sewn in to keep the sock held tightly against the leg.

The prior art also includes combinations of the foregoing moisture control features with other improvements, such as thermal-insulating materials, cushioning, and support materials. Additionally, footwear has been provided that includes specially designed socks as well as complementary shoes. In U.S. Pat. No. 5,353,524, a moisture management sock includes a wicking panel, and air circulation channels. A moisture management shoe is adapted to cooperate with the sock by using a moisture wicking inner liner. Another design using cooperating socks and shoes is shown in U.S. Pat. No. 5,511,323. In that design, the tongue of the shoe overlies a hydrophobic knit instep portion of the sock, and the tongue is perforated to facilitate evaporation.

In addition to the foregoing approaches which use different types of materials (predominantly hydrophobic or hydrophilic) for different panels or portions of the sock, another approach involves the use of specially knits. For example, U.S. Pat. No. 4,195,497 describes an aerated stocking in which regions are knitted with both a synthetic, hydrophobic (nylon) yarn and a moisture-absorbent (cotton) yarn. The knit design not only provides a greater surface area of the synthetic material on the exterior surface than on the interior surface, but additionally provides aeration using air flow interstices knitted in those regions.

All of the foregoing approaches are limited by the amount of surface area available for moisture evaporation. Moreover, none of the prior art stocking constructions provide any way of effectively increasing the surface area of the sock available for moisture evaporation, and so do not take full advantage of the principles of advection and diffusion to increase moisture dissipation. It would, therefore, be desirable to devise a sock construction which allowed increased air flow and moisture control. It would be further advantageous if the construction were amenable to different embodiments to allow for fashion alternatives.

SUMMARY OF THE INVENTION

It is therefore one object of the present invention to provide a sock having improved moisture control.

It is another object of the present invention to provide such a sock which achieves increased moisture dissipation by increasing the effective surface area of the sock available for evaporation.

It is yet another object of the present invention to provide a method of constructing a sock with enhanced surface area for improved moisture control, which is applicable to multiple embodiments so as to allow a variety of selections.

The foregoing objects are achieved in an article of footwear generally comprising a first fabric forming a tubular foot portion having a closed end and an open end, and a second fabric forming a tubular leg portion, attached to the open end of the foot portion, the tubular leg portion having a plurality of wicking regions interspersed among a plurality of fabric folds which are adapted to increase the effective surface area of the leg portion. The first and second fabrics may be constructed of the same material and formed in a unitary manner, either by weaving or knitting. The wicking regions may be formed using stitching along outer edges of a plurality of polygon shapes, e.g., diamonds. Alternatively, the wicking regions may be formed by a set of first fabric bands, wherein the fabric folds comprise a set of second fabric bands, and the first and second bands alternate horizontally along a length of the tubular leg portion. The first fabric bands are preferably elastic to maintain the first fabric bands in intimate contact with a wearer's skin. Elasticity may be imparted using elastic yarns, or a stretch knit.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein:

DESCRIPTION OF AN ILLUSTRATIVE EMBODIMENT

Figure 1:
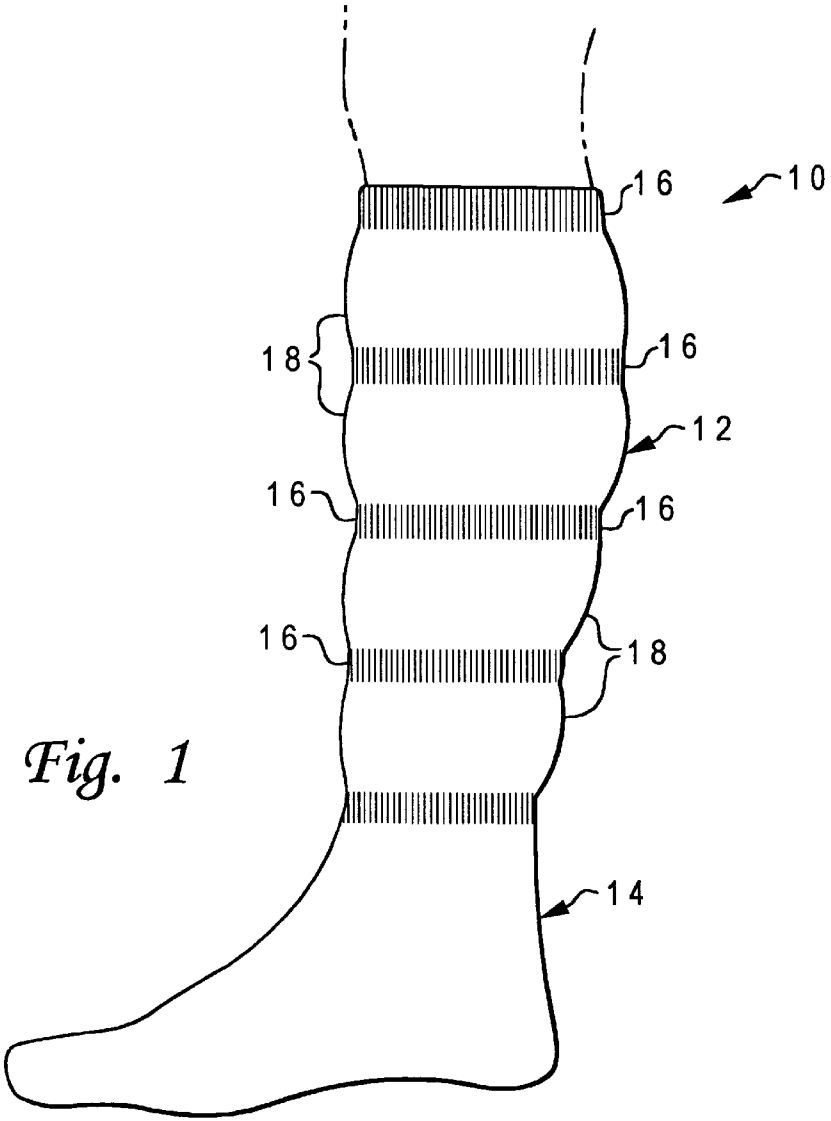
FIG. 1 is a side elevational view of one embodiment of a sock constructed in accordance with the present invention, having a plurality of wicking bands interspersed between moisture-dissipative bands, shown with the sock pulled up the leg.

With reference now to the figures, and in particular with reference to FIG. 1, there is depicted one embodiment 10 of a self cooling stocking or sock constructed in accordance with the present invention. Sock 10 is generally comprised of a tubular foot portion 12 (closed at the toe end) and a tubular leg portion 14. The present invention is directed to a method of constructing sock 10 so as to enhance the effective surface area of leg portion 14 available for moisture absorption and dissipation.

Sock 10 provides for wicking of moisture from the skin of the wearer by fabricating folds or pleats into leg portion 14. In the embodiment of FIG. 1, these folds are created by forming alternating horizontal bands 16 and 18 in leg portion 14. Bands 16 are preferably elastic or stretchable to maintain those bands in intimate contact with the wearer's skin. Bands 16 are narrow in comparison to the wider bands 18. Bands 18 are not elastic and the fabric in these bands is allowed to sag during use.

Figure 2:
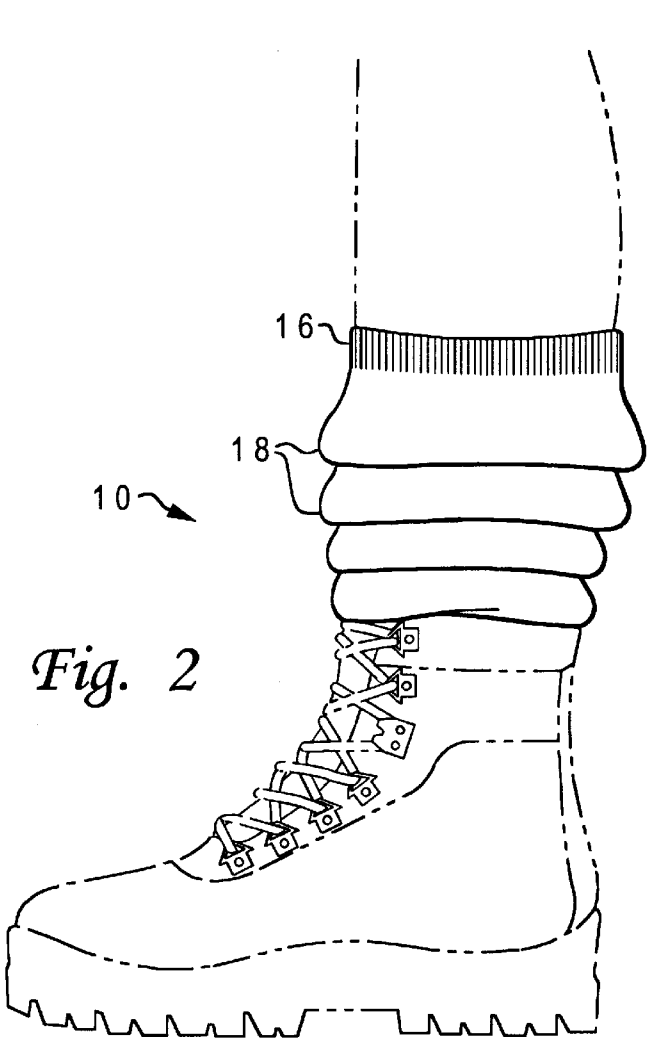
FIG. 2 is a side elevational view of the sock of FIG. 1 shown with a shoe, and with the sock draping down and the moisture-dissipative bands forming folds.

FIG. 1 depicts sock 10 as it would appear when initially pulled all the way up the leg of the wearer. After a short period of time, however, gravity and the centrifugal forces arising from natural walking/running movement pull leg portion 14 of sock 10 down toward the wearer's ankle, as shown in FIG. 2. In this aspect, bands 18 drape outwardly to form folds or pleats that increase the effective surface area of leg portion 14 available for moisture dissipation.

Figure 3:
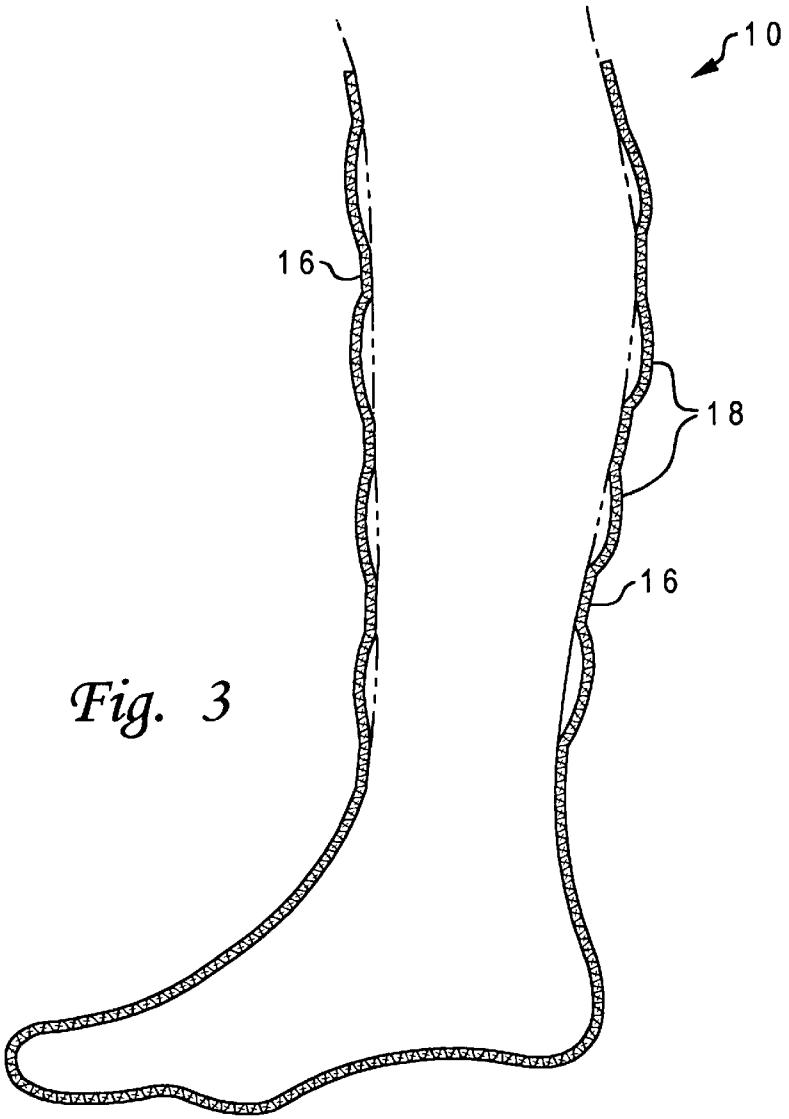
FIG. 3 is a sectional view of the sock depicted in the pulled-up manner of FIG. 1.
Figure 4:
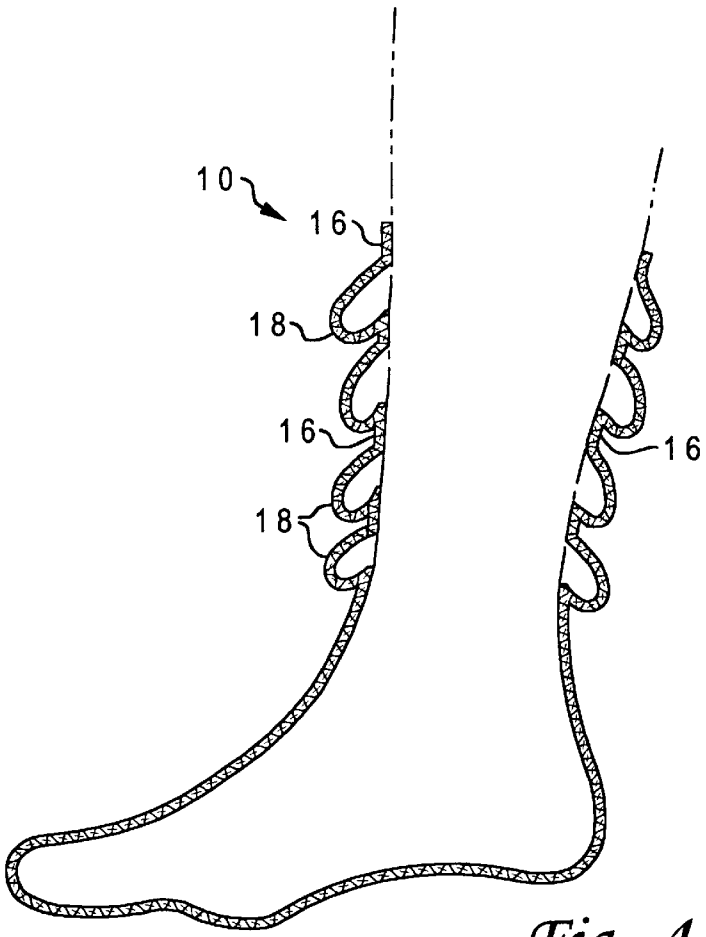
FIG. 4 is a sectional view of the sock depicted in the draping manner of FIG. 2.

Sock 10 is shown in cross-section in FIGS. 3 and 4, which correspond to FIGS. 1 and 2, respectively. As seen in FIG. 3, when the wearer first pulls up the sock, bands 16 maintain intimate contact with the individual's leg. This contact provides the mechanism for the sock to wick perspiration into the adjacent folds. As further seen in FIG. 4, even when leg portion 14 has fallen, bands 16 still provide this intimate contact in a regular, even fashion to facilitate moisture absorption.

Different materials may be used for sock 10 according to the desired level of moisture control. In a simple embodiment, the sock is constructed completely of one wicking material, such as polyester, and the elasticity of bands 16 is imparted by using a stretch knit. The maximum (stretched) circumference of bands 16 may be less than the maximum circumference of bands 18 to facilitate the draping of the folds. Elasticity of bands 16 may alternatively be imparted using elastic yarns. In another embodiment, the yarns in bands 16 are predominantly hydrophobic (e.g., polyester) while the yarns in bands 18 are predominantly hydrophilic (e.g., cotton), to enhance moisture dissipation even more. The fabric used for leg portion 14 could be a weave instead of a knit. The size of the sock is of course dependent upon the foot size of the wearer; the length of the leg portion is variable and could be much longer (or shorter) than that shown in the drawings. The leg and foot portions are preferably formed in a unitary manner, i.e., with continuous yarns forming the underlying fabrics at their juncture.

Figure 6:
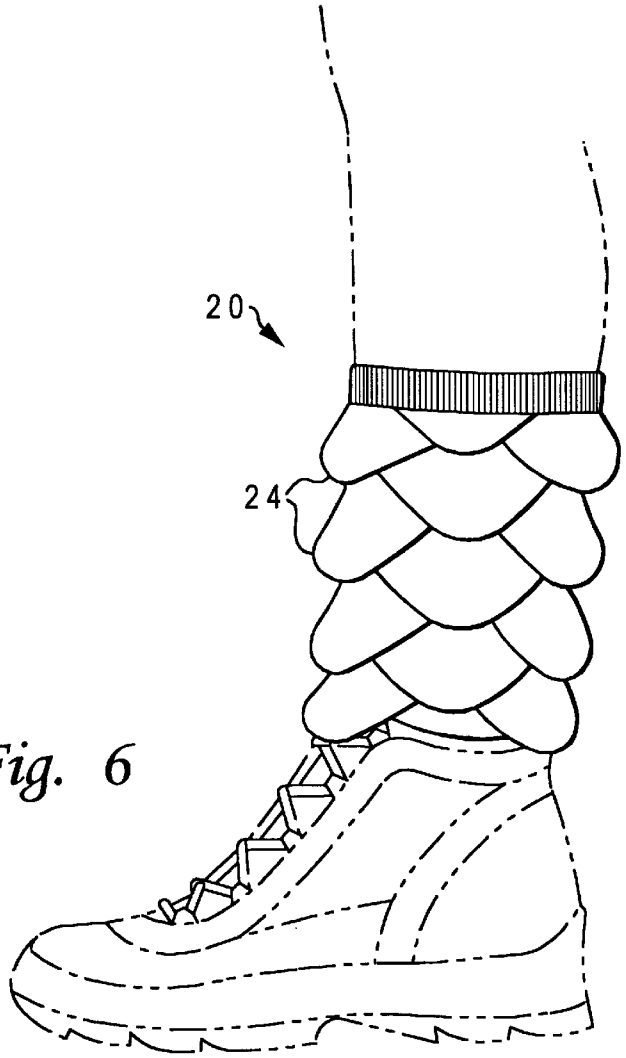
FIG. 6 is a side elevational view of the sock of FIG. 5 shown with a shoe, and with the sock sagging down the moisture-dissipative diamonds forming overlapping folds.
Figure 5:
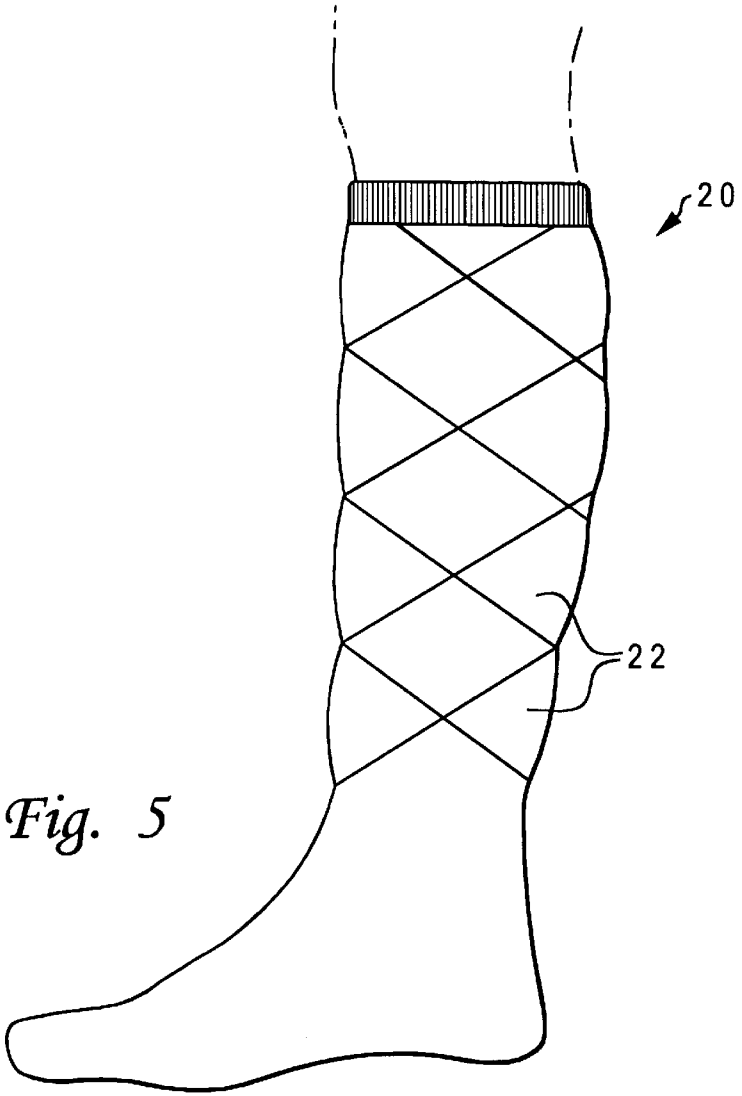
FIG. 5 is a side elevational view of another embodiment of a sock constructed in accordance with the present invention, having a plurality of wicking regions formed by stitching along outer edges of polygon shapes (diamonds), shown with the sock pulled up the leg.

The present invention is not limited to horizontal bands which provide the moisture-dissipative folds, but further contemplates other designs which allow such folds to be created, while still maintaining controlled areas of the fabric in intimate contact with the leg. FIG. 5 depicts another embodiment 20 of a sock constructed in accordance with the present invention, which makes intimate contact with the leg using stitching along the outer edges of polygons, such as diamond shapes 22. The diamond pattern thus created results in the partially overlapping folds 24 as shown in FIG. 6. Those skilled in the art will appreciate that the present invention thus offers a variety of designs to afford the consumer a wider selection.

These designs may be further combined with, e.g., color patterns, to enhance the fashion appeal of the socks. They may also be used in combination with conventional features such as special knitting to provide padded areas for particular sports, or moisture control for foot portion of sock (as described in the Background section). Such moisture control for the foot portion of the sock may provide wicking from the foot portion to the leg portion so as to use the lower folds on the leg portion to assist with dissipation of foot perspiration. Other comfort features may be incorporated, such as blister or abrasion resistant panels, etc.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. It is therefore contemplated that such modifications can be made without departing from the spirit or scope of the present invention as defined in the appended claims.

I claim:

1. An article of footwear comprising:

a first fabric forming a tubular foot portion having a closed end and an open end; and a second fabric forming a tubular leg portion, attached to said open end of said foot portion, said tubular leg portion having a plurality of wicking regions interspersed among a plurality of non-vertical fabric folds adapted to increase the effective surface area of said leg portion.

2. The article of claim 1 wherein said first and second fabrics are constructed of the same material and formed in a unitary manner.

3. The article of claim 1 wherein said second fabric is a weave.

4. The article of claim 1 wherein said second fabric is a knit.

5. The article of claim 1 wherein said folds are partially overlapping.

6. The article of claim 1 wherein said foot portion includes a wicking fabric in contact with said leg portion such that moisture is wicked from said foot portion to said leg portion and dissipated using said folds.

7. The article of claim 1 wherein said wicking regions are formed using stitching along outer edges of a plurality of polygon shapes.

8. The article of claim 1 wherein:

said wicking regions comprise a set of first fabric bands; and said fabric folds comprise a set of second fabric bands, wherein said first and second bands alternate horizontally along a length of said tubular leg portion.

9. The article of claim 8 wherein said first fabric bands are narrow in comparison to said second fabric bands.

10. The article of claim 8 wherein said first fabric bands are elastic to maintain said first fabric bands in intimate contact with a wearer's skin.

11. The article of claim 10 wherein elasticity is imparted to said first fabric bands using a stretch knit.

12. A method of fabricating a sock, comprising the steps of:

forming a tubular foot portion having a closed end and an open;

forming a tubular leg portion having a plurality of wicking regions interspersed among a plurality of non-vertical fabric folds adapted to increase the effective surface area of the leg portion; and attaching the open end of the foot portion to an end of the leg portion.

13. The method of claim 12 wherein said step of forming the tubular leg portion is performed by weaving a fabric for the tubular leg portion.

14. The method of claim 12 wherein said step of forming the tubular leg portion is performed by knitting a fabric for the tubular leg portion.

15. The method of claim 12 wherein said step of forming the tubular leg portion includes the step of forming the wicking regions using stitching along outer edges of a plurality of polygon shapes.

16. The method of claim 12 wherein said step of forming the tubular leg portion includes the steps of:

forming the wicking regions using a set of first fabric bands; and forming the fabric folds using a set of second fabric bands, wherein the first and second bands alternate horizontally along a length of the tubular leg portion.

17. The method of claim 16 wherein said step of forming wicking regions imparts elasticity to the first fabric bands using a stretch knit.

18. A sock having a tubular foot portion with an open end and a closed end, and a tubular leg portion attached to the open end of the foot portion, wherein the improvement comprises a plurality of wicking regions interspersed among a plurality of non-vertical fabric folds on said leg portion, said folds adapted to increase the effective surface area of said leg portion.

19. The sock of claim 18 wherein said wicking regions are formed using stitching along outer edges of a plurality of polygon shapes.

20. The sock of claim 18 wherein:

said wicking regions comprise a set of first, elastic fabric bands; and said fabric folds comprise a set of second fabric bands, wherein said first and second bands alternate horizontally along a length of said tubular leg portion.

* * * * *